US006264053B1

(12) United States Patent
Slat

(10) Patent No.: US 6,264,053 B1
(45) **Date of Patent: *Jul. 24, 2001**

(54) BLOW MOLDED BOTTLE HAVING RIBBED HAND GRIPS

(75) Inventor: William A. Slat, Brooklyn, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,338

(22) Filed: May 11, 2000

Related U.S. Application Data

(63) Continuation of application No. 09/321,365, filed on May 27, 1999, now abandoned.

(51) Int. Cl.[7] ..... B65D 45/24
(52) U.S. Cl. ..... 215/384; 215/382; 215/383
(58) Field of Search ..... 215/384, 382, 215/383, 398; 220/615

(56) References Cited

U.S. PATENT DOCUMENTS

| | | |
|---|---|---|
| D. 196,389 | 9/1963 | Mason et al. . |
| D. 218,018 | 7/1970 | Lattraye . |
| D. 277,551 | 2/1985 | Kerr . |
| D. 278,978 | 5/1985 | Franchi et al. . |
| D. 279,167 | 6/1985 | Haney et al. . |
| D. 282,349 | 1/1986 | Larson et al. . |
| D. 319,584 | 9/1991 | Biesecker . |
| D. 332,051 | 12/1992 | Kinslow, Jr. et al. . |
| D. 352,245 | 11/1994 | Krishnakumar et al. . |
| D. 370,634 | 6/1996 | Mero et al. . |
| D. 376,319 | 12/1996 | Miller . |
| D. 383,067 | 9/1997 | Gower et al. . |
| D. 386,418 | 11/1997 | Edstrom et al. . |
| D. 387,672 | 12/1997 | Biesecker . |
| D. 393,210 | 4/1998 | Ewing, Jr. . |
| 1,636,174 | 7/1927 | Dolan et al. . |
| 4,890,752 | 1/1990 | Ota et al. . |
| 4,993,565 | 2/1991 | Ota et al. . |
| 5,141,120 | 8/1992 | Brown et al. . |
| 5,141,121 | 8/1992 | Brown et al. . |
| 5,148,930 | 9/1992 | Ota et al. . |
| 5,156,557 | 10/1992 | Okafuji et al. . |
| 5,199,587 | 4/1993 | Ota et al. . |
| 5,472,105 | 12/1995 | Krishnakumar et al. . |
| 5,579,937 | 12/1996 | Valyi . |
| 5,598,941 | 2/1997 | Semersky et al. . |
| 5,690,244 | 11/1997 | Darr . |
| 5,732,838 | 3/1998 | Young . |
| 5,758,790 | 6/1998 | Ewing, Jr. . |
| 6,029,837 | 2/2000 | Slat et al. . |

*Primary Examiner*—Sue A. Weaver
(74) *Attorney, Agent, or Firm*—Brooks & Kushman P.C.

(57) ABSTRACT

A plastic blow molded bottle (10) includes a body portion (16) that extends vertically between a lower base (12) and an upper dispensing end (14) and includes a pair of inwardly extending hand grips (28) with contiguous vertical ribs (34) that extend between a lower end (30) of each hand grip and an upper open end (32) of the hand grip. The vertically ribbed construction of the hand grips (28) with the lower end (30) and the open upper end (32) facilitates manual handling of the bottle, as well as permitting flexing that accommodates for different internal volumes of the bottle in order to permit hot filling.

13 Claims, 3 Drawing Sheets

Fig. 1
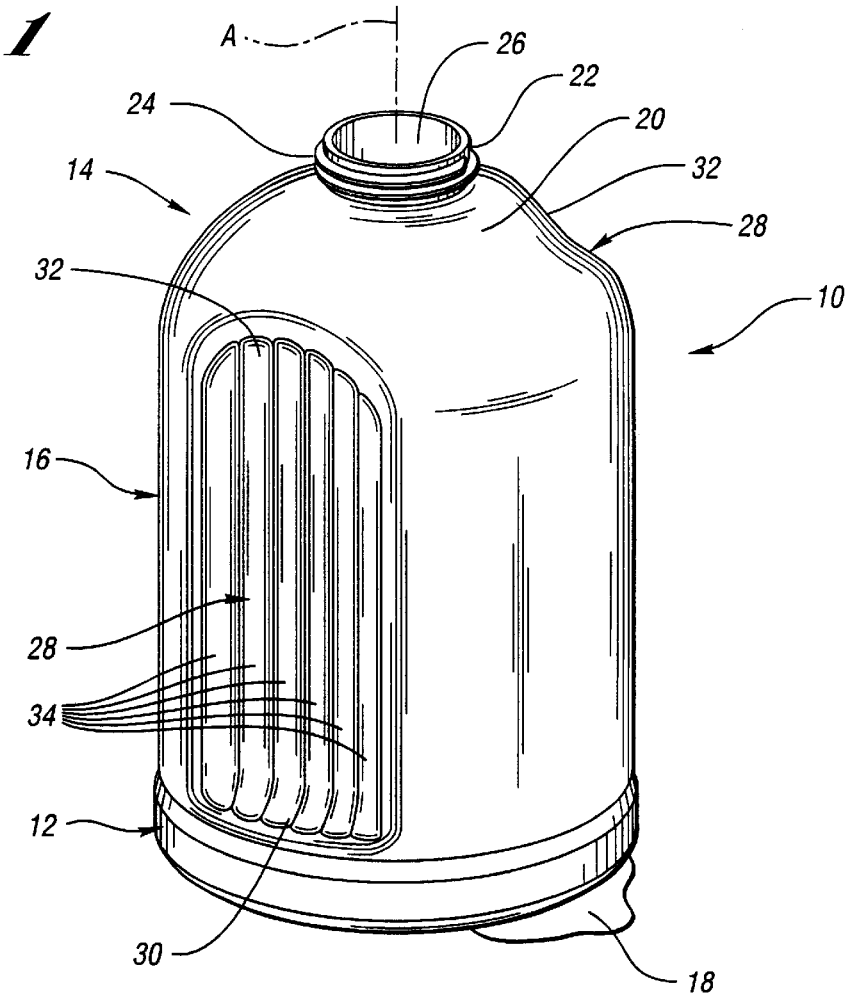
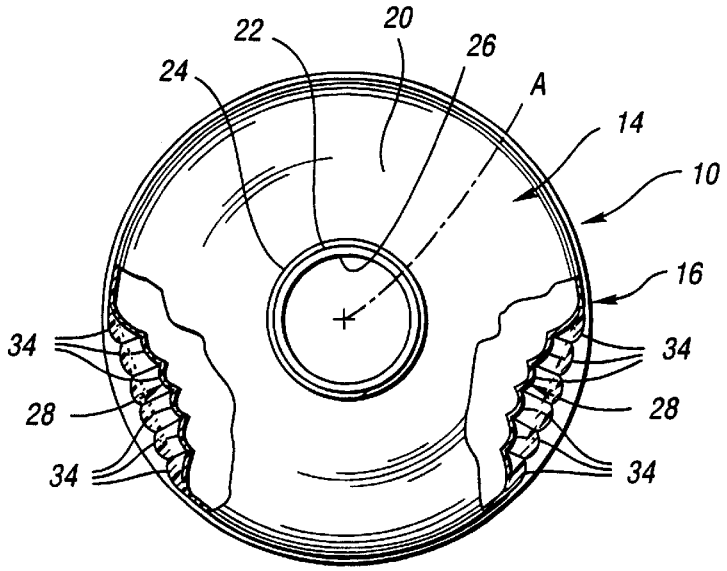
Fig. 2

Fig. 4
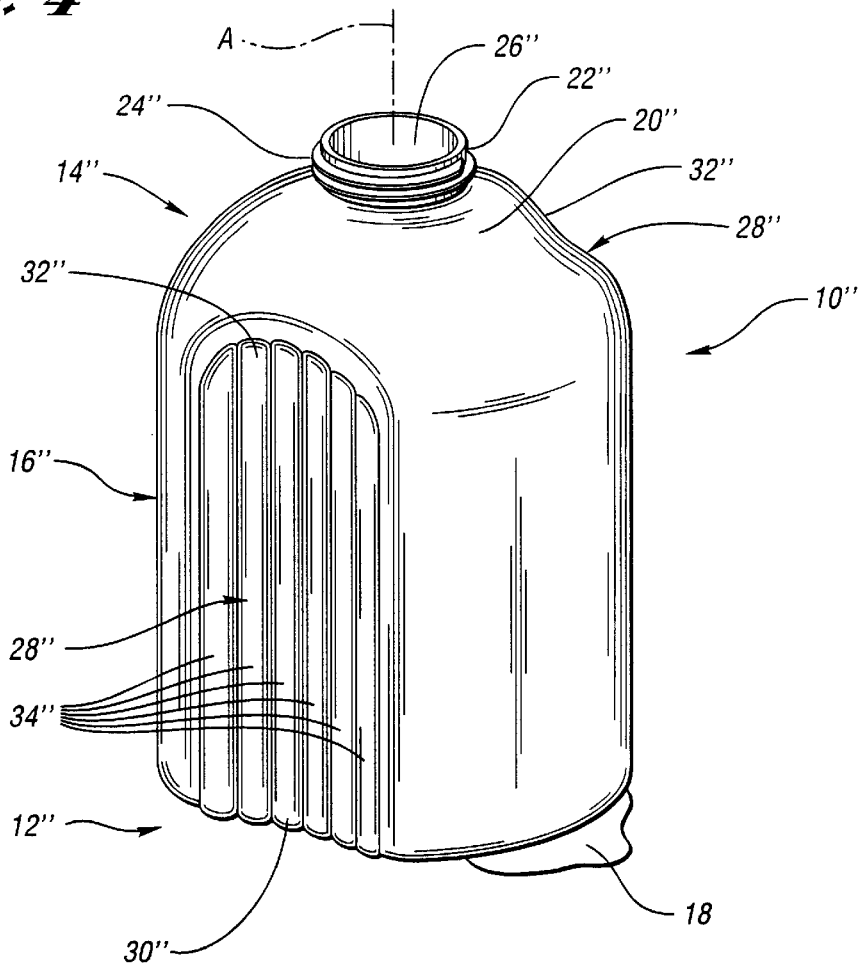
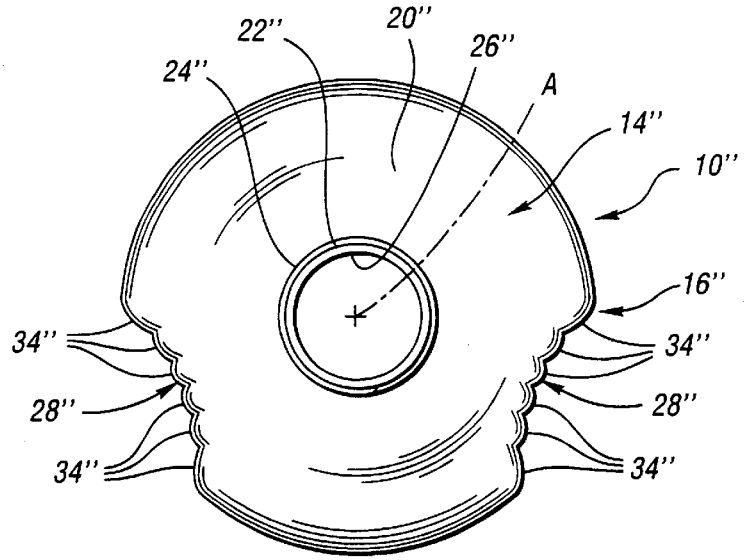
Fig. 5

BLOW MOLDED BOTTLE HAVING RIBBED HAND GRIPS

This is a continuation of application Ser. No. 09/321,365 filed on May 27, 1999, now abandoned.

TECHNICAL FIELD

This invention relates to a plastic blow molded bottle that can be easily handled and also can be hot filled.

BACKGROUND ART

Plastic blow molded bottles conventionally include a body portion that extends between a lower base and an upper dispensing end. In order to facilitate manual handling, such bottles have previously included inwardly extending hand grips and have also had these grips constructed to include ribs that provide strengthening. Examples of such bottles are disclosed by United States Patents Des. 196,389, Mason et al.; Des.277,551, Kerr; Des. 278,978, Franchi et al.; Des. 279,167, Haney et al.; Des. 282,349, Larson et al.; Des. 319,584, Biesecker; Des. 332,051, Kinslow, Jr. et al.; Des. 352,248, Krishnakumar et al.; Des. 370,634, Mero et al.; Des. 376,319, Miller; Des. 383,067, Gower et al.; Des. 386,418, Edstrom et al.; Des. 387,672, U.S. Pat. Nos: Biesecker; 1,636,174, Dolan et al.; 4,890,752, Ota et al.; 4,993,565, Ota et al.; 5,141,120, Brown et al.; 5,141,121, Brown et al.; 5,148,930, Ota et al.; 5,156,557, Okafuji et al.; 5,199,587 Ota et al.; 5,472,105, Krishnakumar et al.; 5,579, 937, Valyi; 5,598,941, Semersky et al.; 5,732,838, Young; and 5,758,790, Ewing, Jr.

Plastic blow molded bottles have also previously included panels that flex inwardly and outwardly to accommodate for volume changes such as disclosed by U.S. Pat. No. 5,690, 244, Darr. Such flexing allows the bottle to be hot filled and sealed without changing its overall appearance upon the contraction that accompanies cooling.

DISCLOSURE OF INVENTION

An object of the present invention is to provide an improved plastic blow molded bottle that can be easily handled and also has the capability of flexing to accommodate the contraction that follows hot filling and sealing of the bottle as its contents are cooled.

In carrying out the above object, a plastic blow molded bottle constructed in accordance with the invention includes a lower base for supporting the bottle in an upstanding manner on a horizontal support surface. An upper dispensing end of the bottle includes a shoulder and a dispensing opening from which the shoulder extends outwardly from a vertically extending central axis of the bottle. A body portion of the bottle extends vertically between the lower base and the upper dispensing end. This body portion includes a pair of inwardly extending hand grips that are spaced from each other circumferentially around the central axis. Each hand grip extends vertically and has a lower end located adjacent the lower base and an upper open end located adjacent the upper dispensing end. Each hand grip includes a plurality of vertical ribs that extend vertically the entire height thereof between the lower end thereof adjacent the lower base and the upper open end thereof adjacent the shoulder of the upper dispensing end. The vertical ribs of each hand grip are contiguous with each other to allow flexing that accommodates for different internal volumes of the bottle.

The manner in which the hand grips have upper open ends adjacent the upper dispensing end and the contiguous vertical ribs that extend the entire height of the hand grips allows the flexing that accommodates for different internal volumes of the bottle and thereby permits it to flex for contraction upon cooling that follows hot filling as well as providing a convenient hand grip for grasping of the bottle.

In the preferred construction of the plastic blow molded bottle, the body portion has a generally round shape extending about the central axis with the pair of hand grips extending inwardly from its generally round shape.

One embodiment of the bottle has the hand grips provided with lower closed ends.

In another embodiment, the hand grips have lower closed ends and the lower base includes lower rib extensions that extend downwardly from the ribs of the pair of hand grips. In addition, the shoulder of the upper dispensing end of this embodiment includes upper rib extensions that extend upwardly from the ribs of the pair of hand grips. This embodiment also has the body portion provided with additional vertically extending ribs that are contiguous with each other between the hand grips. Furthermore, the lower base of this embodiment includes lower rib extensions that extend downwardly from the additional vertically extending ribs of the body portion. Also, the shoulder of the upper dispensing end of this embodiment includes upper rib extensions that extend upwardly from the additional vertically extending ribs of the body portion.

A further embodiment of the bottle has the hand grips provided with lower open ends adjacent the lower base.

The objects, features and advantages of the present invention are readily apparent from the following detailed description of the best mode for carrying out the invention when taken in connection with the accompanying drawings.

BRIEF DESCRIPTION OF DRAWINGS

FIG. 1 is a perspective view of one embodiment of a plastic blow molded bottle constructed in accordance with the invention.

FIG. 2 is a top plan view of the bottle but partially broken away to illustrate the construction of its hand grips.

FIG. 4 is a perspective view of a further embodiment of a blow molded bottle constructed in accordance with the invention.

FIG. 5 is a top plan view of the bottle embodiment shown in FIG. 4.

BEST MODE FOR CARRYING OUT THE INVENTION

Figure 3:
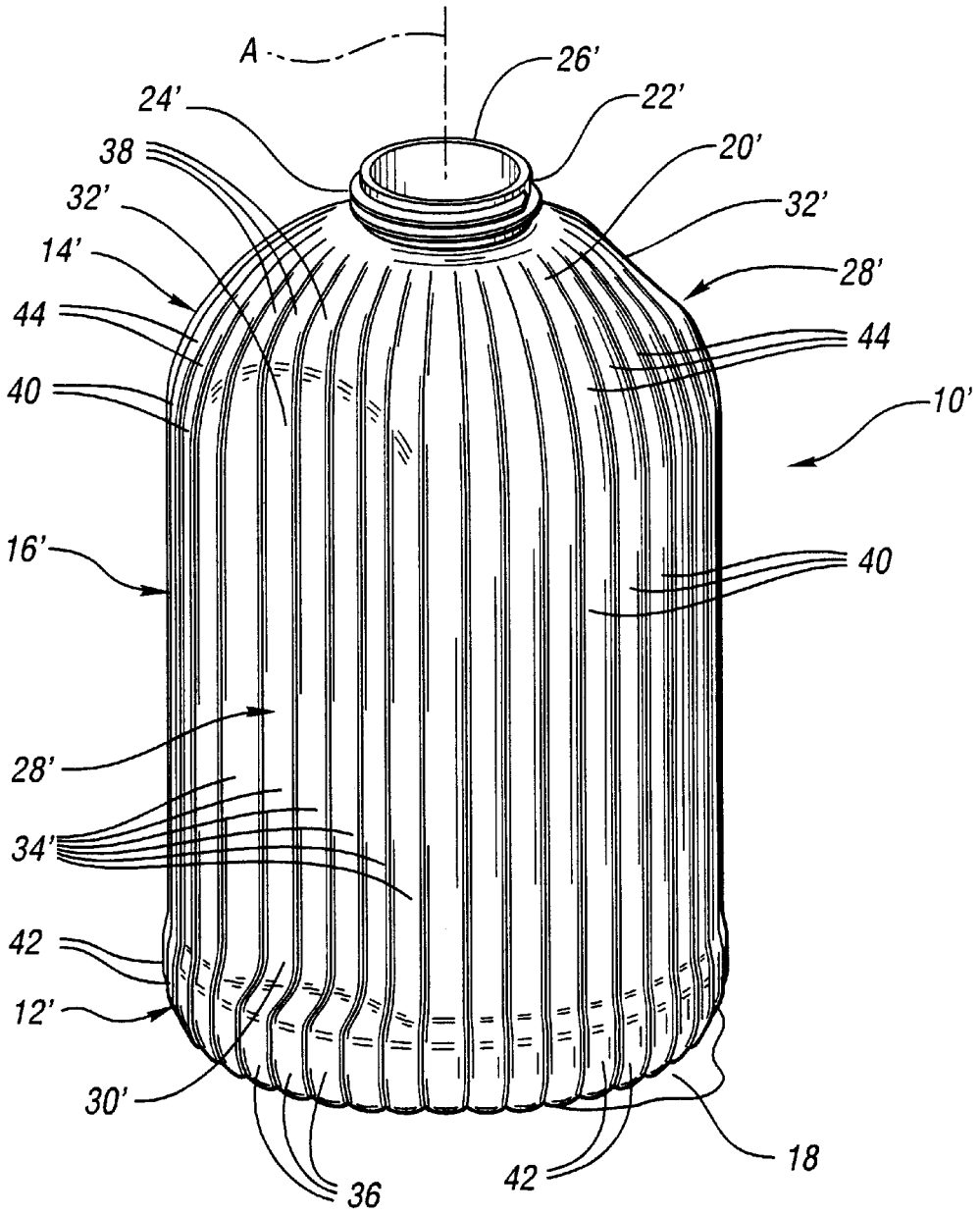
FIG. 3 is a perspective view of another embodiment of a plastic blow molded bottle constructed in accordance with the invention.

With reference to FIG. 1 of the drawings, a plastic blow molded bottle constructed in accordance with the invention is generally indicated by 10 and is illustrated as including a lower base 12, an upper dispensing end 14, and a body portion 16 that extends vertically between the lower base and the upper dispensing end. The lower base supports the bottle in an upstanding manner on a horizontal support surface 18. The upper dispensing end includes a shoulder 20 and a dispensing spout 22 that has retainer threads 24 for an unshown closure cap. The dispensing spout defmes a dispensing opening 26 from which the shoulder 20 extends outwardly from a vertically extending central axis A of the bottle.

With continuing reference to FIG. 1, the body portion 16 as previously mentioned extends vertically between the lower base 12 and the upper dispensing end 14 of the bottle. This body portion 16, as also shown in FIG. 2, includes a pair of inwardly extending hand grips 28 that are spaced from each other circumferentially about the central axis A. Each hand grip 28 extends vertically and has a lower end 30 adjacent the lower base and an upper open end 32 located adjacent the upper dispensing end 14. Each hand grip 28 includes a plurality of vertical ribs 34 that extend vertically the entire height of the hand grip between the lower end 30 thereof adjacent the lower base and the upper open end 32 adjacent the shoulder of the upper dispensing end. These vertical ribs 34 of each hand grip are contiguous with each other with the lateral margin of each rib joined to the lateral margin of the adjacent rib. The construction of the hand grips with the lower closed ends 30 and the upper open ends 32 together with the contiguous vertical ribs 34 allows flexing that accommodates for different internal volumes within the bottle. More specifically, this flexing allows the dispensing opening 26 to be sealed by a closure cap after hot filling and the subsequent contraction that takes place upon cooling of the contents is accommodated for by the flexing.

As illustrated in FIG. 2, the disclosed construction of the bottle 10 has a generally round shape extending around the central axis A with the pair of hand grips 28 extending inwardly from this generally round shape. Also, this embodiment of the bottle 10 has the hand grips 28 provided with lower closed ends 30 adjacent the base 12.

With reference to FIG. 3, another embodiment of the plastic blow molded bottle is indicated by 10' and has generally the same construction as the previously described embodiment except as will be noted such that corresponding prime reference numerals are utilized for like components thereof and much of the previous description is applicable so that it need not be repeated.

In the embodiment of FIG. 3, the hand grips 28' have lower closed ends 30 and the lower base 12' includes lower rib extensions 36 that extend downwardly from the ribs 34' of the pair of hand grips 28'. In addition, the upper dispensing end 14' includes upper rib extensions 38 that extend upwardly from the vertical ribs 34' of the pair of hand grips 28'. Thus, the bottle 10' includes both the lower rib extensions 36 and the upper rib extensions 38 extending downwardly and upwardly from the vertical ribs 34' of the pair of hand grips 28'.

With continuing reference to FIG. 3, the bottle 10' also includes additional vertically extending ribs 40 that are contiguous with each other between the hand grips 28' on both sides of the central axis A. The lower base 12' also includes lower rib extensions 42 that extend downwardly from the additional vertically extending ribs 40 of the body portion 16'. In addition, the shoulder 20' of the upper dispensing end 14' includes upper rib extensions 44 that extend upwardly from the additional vertically extending ribs 40 of the body portion 16'. Thus, the bottle has both the lower and upper rib extensions 42 and 44 extending downwardly and upwardly from the additional vertically extending ribs 40 located between the hand grips 28'.

With reference to FIGS. 4 and 5, another embodiment of the plastic blow molded bottle is indicated by 10" and has generally the same construction as the previously described embodiments except as will be noted such that corresponding double prime reference numerals are utilized for like components thereof and much of the previous description is applicable so that it need not be repeated.

The bottle 10" shown in FIGS. 4 and 5 has its hand grips 28" provided with lower open ends 30" adjacent the lower base 12".

The bottle 10,10'. 10" is advantageously made by injection stretch blow molding from a preform having a shorter height than the blown bottle. Polyethylene terephthalate resin is most preferably utilized to blow mold the bottle. Also, the upper dispensing end 14 of the bottle can have a longer vertical spout than the relatively short spout shown.

While the best mode for carrying out the invention has been described in detail, those familiar with the art to which this invention relates will recognize various alternative designs and embodiments for practicing the invention as defined by the following claims.

What is claimed is:

1. A plastic blow molded bottle, comprising:

a lower base for supporting the bottle in an upstanding manner on a horizontal support surface;

an upper dispensing end including a shoulder and a dispensing opening from which the shoulder extends outwardly from a vertically extending central axis of the bottle;

a body portion that extends vertically between the lower base and the upper dispensing end, said body portion including a pair of inwardly extending hand grips that are spaced from each other circumferentially about the central axis, each hand grip extending vertically and having a lower end located adjacent the lower base and an upper open end located adjacent the upper dispensing end, each hand grip including a plurality of vertical ribs that extend vertically the entire height thereof between the lower end thereof adjacent the lower base and the upper open end thereof adjacent the shoulder of the upper dispensing end, and the vertical ribs of each hand grip being contiguous with each other to allow flexing that accommodates for different internal volumes within the bottle.

2. A plastic blow molded bottle as in claim 1 wherein the body portion has a generally round shape extending about the central axis with the pair of hand grips extending inwardly from its generally round shape.

3. A plastic blow molded bottle as in claim 1 wherein the hand grips have lower closed ends.

4. A plastic blow molded bottle as in claim 1 wherein the hand grips have lower closed ends and the lower base includes lower rib extensions that extend downwardly from the ribs of the pair of hand grips.

5. A plastic blow molded bottle as in claim 1 wherein the shoulder of the upper dispensing end includes upper rib extensions that extend upwardly from the ribs of the pair of hand grips.

6. A plastic blow molded bottle as in claim 1 wherein the hand grips have lower closed ends and the lower base includes lower rib extensions that extend downwardly from the ribs of the pair of hand grips, and the shoulder of the upper dispensing end including upper rib extensions that extend upwardly from the ribs of the pair of hand grips.

7. A plastic blow molded bottle as in claim 1 wherein the body portion also includes additional vertically extending ribs that are contiguous with each other between the hand grips.

8. A plastic blow molded bottle as in claim 7 wherein the lower base includes lower rib extensions that extend downwardly from the additional vertically extending ribs of the body portion.

9. A plastic blow molded bottle as in claim 7 wherein the shoulder of the upper dispensing end includes upper rib extensions that extend upwardly from the additional vertically extending ribs of the body portion.

10. A plastic blow molded bottle as in claim 7 wherein the lower base includes lower rib extensions that extend downwardly from the additional vertically extending ribs of the body portion, and the shoulder of the upper dispensing end including upper rib extensions that extend upwardly from the additional vertically extending ribs of the body portion.

11. A plastic blow molded bottle as in claim 1 wherein the hand grips have lower open ends.

12. A plastic blow molded bottle, comprising:

a lower base for supporting the bottle in an upstanding manner on a horizontal support surface;

an upper dispensing end including a shoulder and a dispensing opening from which the shoulder extends outwardly from a vertically extending central axis of the bottle;

a generally round body portion that extends vertically between the lower base and the upper dispensing end, said body portion including a pair of inwardly extending hand grips that are spaced from each other circumferentially about the central axis, each hand grip extending vertically and having a lower closed end located adjacent the lower base and an upper open end located adjacent the upper dispensing end, each hand grip including a plurality of vertical ribs that extend vertically the entire height thereof between the lower closed end thereof adjacent the lower base and the upper open end thereof adjacent the shoulder of the upper dispensing end, and the vertical ribs of each hand grip being contiguous with each other to allow flexing that accommodates for different internal volumes within the bottle.

13. A plastic blow molded bottle, comprising:

a lower base for supporting the bottle in an upstanding manner on a horizontal support surface;

an upper dispensing end including a shoulder and a dispensing opening from which the shoulder extends outwardly from a vertically extending central axis of the bottle;

a generally round body portion that extends vertically between the lower base and the upper dispensing end, said body portion including a pair of inwardly extending hand grips that are spaced from each other circumferentially about the central axis, each hand grip extending vertically and having a lower open end located adjacent the lower base and an upper open end located adjacent the upper dispensing end, each hand grip including a plurality of vertical ribs that extend vertically the entire height thereof between the lower open end thereof adjacent the lower base and the upper open end thereof adjacent the shoulder of the upper dispensing end, and the vertical ribs of each hand grip being contiguous with each other to allow flexing that accommodates for different internal volumes within the bottle.

* * * * *